United States Patent [19]

Tanaka

[11] 4,156,753

[45] May 29, 1979

[54] FLEXIBLE COATING FORMED ON FABRIC PRETREATED WITH A REPELLING LAYER

[76] Inventor: Akio Tanaka, No. 565 Tohori, Himeji-shi, Hyogo-ken, Japan

[21] Appl. No.: 917,736

[22] Filed: Jun. 21, 1978

[51] Int. Cl.[2] ..... A41D 19/00; B05D 1/36; B32B 27/08; B32B 27/12

[52] U.S. Cl. ..... 427/245; 2/161 R; 128/290 W; 427/259; 427/300; 427/412; 428/253; 428/255; 428/262

[58] Field of Search ..... 427/300, 259, 412; 428/255, 253, 262, 245; 128/290 W; 2/161 R

[56] References Cited

U.S. PATENT DOCUMENTS

| | | | |
|---|---|---|---|
| 2,776,868 | 1/1957 | Russell et al. | 427/259 |
| 3,507,675 | 4/1970 | Noda et al. | 427/300 |
| 3,672,934 | 6/1972 | Larry | 427/259 |

*Primary Examiner*—J. C. Cannon

*Attorney, Agent, or Firm*—Thomas R. Morrison

[57] ABSTRACT

This invention relates to a fiber product formed by flexible coating, the fiber product being made of a cloth knitted or woven by fiber yarns. Each space between the fiber yarns facing to each other is formed 1.5 to 4 times as large as the thickness of each fiber yarn, and a repelling layer of a preferred resin is coated on the outer overall surface of the fiber yarns, subsequently a thin, expansible and flexible layer of polyvinyl chloride resin being, under no pressure, coated on one outer portion of the fiber yarns by the polyvinyl chloride resin paste. As a result, the repelling layer can prevent the polyvinyl chloride resin paste from penetrating into the space between the facing fiber yarns.

5 Claims, 6 Drawing Figures

FLEXIBLE COATING FORMED ON FABRIC PRETREATED WITH A REPELLING LAYER

BACKGROUND OF THE INVENTION

A typical fiber product of this sort is a work glove or a sheet made of cloth woven or knitted by fiber yarns, the work glove or the sheet being formed by a vinyl chloride resin layer. It is known that the fiber products formed by a vinyl chloride resin layer are manufactured mainly by a dipping method and partially by a coating method.

Referring first to the dipping method, a knitted or woven cloth is dipped into a vinyl chloride resin paste. As shown in FIG. 1*a*, when each space between the fiber yarns facing to each other is wider, the vinyl chloride resin paste is penetrated into the space between the facing fiber yarns due to the liquid pressure, and the above fiber yarns are enclosed by the vinyl chloride resin paste. In other words, the former is thrusted into the latter. As a result, the thickness of a vinyl chloride resin layer 2 becomes larger, so that the fiber product provided with the above treatment becomes hard and unexpansible in itself. From this point of view, in the dipping method there is generally used a knitted cloth in which each space of the facing fiber yarns is close. This is an example of FIG. 1*b*. In this example, the vinyl chloride resin paste containing an oily plasticizer is permeated into the fiber yarns 1. Subsequently, since the vinyl chloride resin paste is induced into each space between the facing fiber yarns 1, both the former and the latter are interwound. In other words, the fiber yarns 1 are thickly enclosed by the above paste. Consequently, the thickness of the vinyl chloride resin layer 2 becomes larger, thereby the fiber product being hard and unexpansible.

Referring to the coating method, no liquid pressure of the vinyl chloride resin paste is applied, so that as shown in FIG. 1*a* the vinyl chloride resin paste can be coated even in enlarged spaces between the fiber yarns 1. However, as described above, the vinyl chloride resin paste containing an oily plasticizer is permeated into the fiber yarns 1 and it is induced to each space between the facing fiber yarns 1. Therefore, the vinyl resin layer 2 becomes thicker and the fiber product coated by such a thicker layer becomes inflexible and unexpansible.

In order to eliminate the foregoing disadvantages, a high viscosity vinyl chloride paste of 9,000 to 15,000 cP (centipoise) level can be used. But even if such a paste is employed, its penetration into the spaces between the facing fiber yarns 1 is prevented only a little bit. And the thickness of the vinyl chloride resin layer 2 is not particularly decreased.

Further, after the spaces between the facing fiber yarns 1 of a knitted or woven cloth have been covered by polyacryl resin emulsion or a polyvinyl chloride (p.v.c.) powder, there is known a method of coating a relatively high viscosity p.v.c. resin paste of e.g. 8,000 cP level or a method of dipping a knitted or woven cloth into the p.v.c. resin paste. However, because the spaces of the fiber yarns are thickly enclosed by the above paste, the foregoing disadvantage cannot be overcome.

As pointed out above, a conventional fiber product formed by flexible coating has a thicker vinyl chloride resin layer by which are enclosed the fiber yarns of a knitted or woven cloth. For example, when this fiber product is applied to a work glove, because of its considerable thickness a user's operability is neither comfortable nor efficient. In other words, due to a dull expansibility of the work glove, the user's feeling in holding a certain object is bad, and the user's hands are apt to become tired. Further, when this fiber product is applied to a diaper cover, it is not agreeable to the touch because of its hardness and unexpansibility.

In order to overcome the aforegoing defects of the conventional art, the present invention has been achieved.

BRIEF SUMMARY OF THE INVENTION

Accordingly, it is an object of the present invention to provide a fiber product such as a work glove or a diaper cover which is formed by a thin, strong, flexible and expansible layer of polyvinyl chloride resin, and thereby agreeable to a user's touch.

It is another object of the present invention to provide a fiber product formed by a thin, strong, flexible and expansible layer of polyvinyl chloride, in which the consumption of the polyvinyl chloride resins and fiber yarns has been saved by thinning the polyvinyl chloride resin layer and widening the spaces between the first yarns facing to each other.

Speaking more concretely, each space between the facing fiber yarns of a knitted or woven cloth is to be formed 1.5 to 4 times as large as the thickness of each fiber yarn, and the outer overall surface of the fiber yarns are to be coated by a layer capable of repelling any coating material like a polyvinyl chloride, resin paste. This repelling layer prevents a polyvinyl chloride resin paste (hereinafter called "p.v.c. resin") from penetrating into the spaces between the facing fiber yarns or from permeating into the fiber yarns. Accordingly, the p.v.c. resin paste can be coated under no pressure on one outer portion of the fiber yarns. The thus obtained expansible and flexible p.v.c. layer is applicable to a work glove, a diaper cover, a sheet or the like.

Other and further objects, features and advantages of the present invention will appear more fully from the following description.

DETAILED DESCRIPTION OF THE INVENTION

Figure 1A:
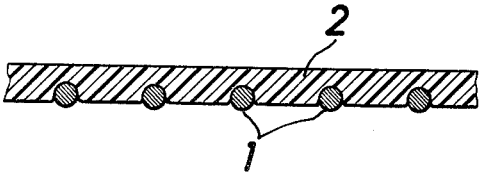
FIG. 1*a* and FIG. 1*b* are each a partially cutaway vertical section view of a conventional fiber product formed by flexible coating.
Figure 1B:
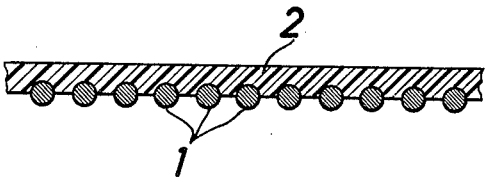
Figure 2:
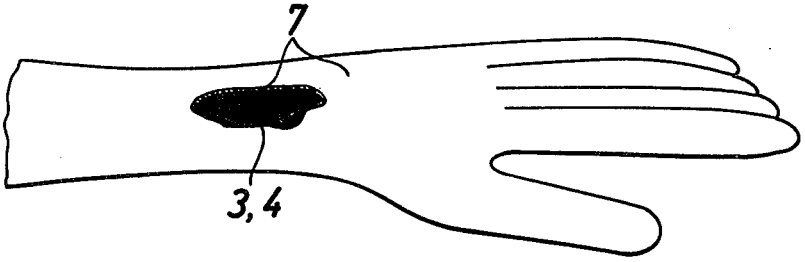
FIG. 2 is a perspective view of a work glove as an example according to the present invention.
Figure 3A:
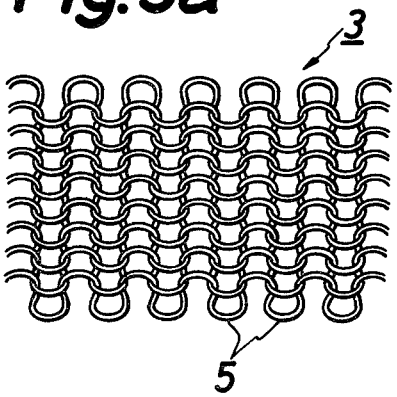
FIG. 3*a* is an enlarged front view of a knitted cloth for the work glove in FIG. 2.
Figure 3B:
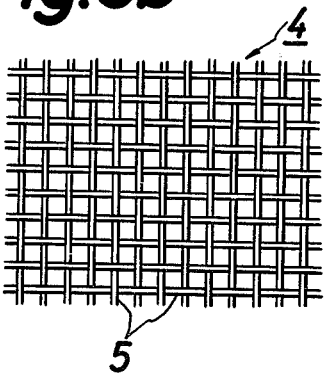
FIG. 3*b* is an enlarged front view of a woven cloth for the work glove in FIG. 2.
Figure 4:
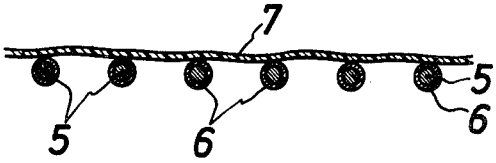
FIG. 4 is a partially cutaway vertical section view of the work glove in FIG. 2.

A work glove as an example of this invention will now be described with reference to FIGS. 2, 3*a*, 3*b* and 4. Numeral 3 is a cloth knitted by fiber yarns 5 and numeral 3 is a cloth woven by the fiber yarns 5. Each space between the fiber yarns 5 facing to each other is formed 1.5 to 4 times as large as the thickness of the fiber yarn 5. Numeral 6 is a repelling layer med of fluorine resin, silicon resin or the like having oil repellency, and the repelling layer 6 is coated on the outer overall surface of the fiber yarns 5. Numeral 7 is a layer made of p.v.c. resin which has been heated and geled by dropping a p.v.c. resin paste on the cloth 3 or 4 under no liquid pressure or by spraying it thereupon without any pressure. The above repelling layer 6 can prevent the p.v.c. resin paste containing oily plasticizer from penetrating into each space between the facing fiber yarns 5, so that the p.v.c. resin layer 7 can be coated thinly as if it is just mounted on one outer portion of the fiber yarns 5 of the cloth 3 or 4.

Further, when each space between the fiber yarns 5 facing to each other is over four times larger than the thickness of each yarn, the weight of the p.v.c. resin paste becomes excessive, subsequently it having the danger to penetrate into the space between the facing fiber yarns 5. Accordingly, each space between the facing fiber yarns 5 is to be limited up to four times larger than the thickness of each yarn.

The p.v.c. resin layer 7 coated on the work glove as specified above is so thin, expansible and flexible that its operability is remarkably improved. Particularly, when a user grasps an object by this work glove, its grasping feeling is very natural, so that it is available for a smooth motion of fingers.

Further, the p.v.c. resin layer is formed so thin that its consumption can be curtailed. Still further, since it is possible to widen the space between the yarns 5 of the cloth 3 or 4, it is also available for saving the comsumption of yarns.

What is claimed is:

1. A fiber product formed by flexible coating, comprising a cloth knitted or woven of fiber yarns, the space between adjacent fiber yarns being 1.5 to 4 times as large as the thickness of each fiber yarn, a repelling layer of resin coated on the outer overall surface of the fiber yarns, and a thin, expansible and flexible layer of polyvinyl chloride resin being coated on at least one outer portion of the fiber yarns with the repelling layer preventing the polyvinyl chloride resin from substantially penetrating into the space between the facing fiber yarns during the coating thereof.

2. A fiber product claimed in claim 1, wherein the repelling layer is made of fluorine resins, silicon resin or the like.

3. A fiber product claimed in claim 1, in the form of a work glove, a diaper cover, or a sheet.

4. A fiber product claimed in claim 1, produced by a process wherein the consumption of the fiber yarns and of the polyvinyl chloride resin involved is modified by widening the space between the facing fiber yarns and thinning the layer of the polyvinyl chloride resin.

5. A method of forming a flexible coated fiber product comprising:

(a) knitting or weaving a cloth of fiber yarn having spaces between adjacent fibers of from about 1.5 to about 4 times the thickness of said fiber yarn;

(b) coating a repelling layer on the outer overall surface of the fiber yarn in said cloth; and (c) coating at least one surface of said fiber yarn under no pressure with a thin expansible polyvinyl chloride resin paste whereby the repelling layer prevents the polyvinyl chloride resin paste from penetrating substantially into said spaces.

* * * * *